US007008018B2

(12) United States Patent
Chen

(10) Patent No.: US 7,008,018 B2
(45) Date of Patent: Mar. 7, 2006

(54) ADJUSTABLE HIGH CHAIR

(75) Inventor: Shun-Min Chen, Taipei Hsien (TW)

(73) Assignee: Wonderland Nurserygoods Co., Ltd., (TW)

( * ) Notice: Subject to any disclaimer, the term of this patent is extended or adjusted under 35 U.S.C. 154(b) by 298 days.

(21) Appl. No.: 10/633,761

(22) Filed: Aug. 4, 2003

(65) Prior Publication Data

US 2005/0029852 A1 Feb. 10, 2005

(51) Int. Cl.
*A47D 1/00* (2006.01)

(52) U.S. Cl. ..... 297/363; 297/364; 297/361.1; 297/368

(58) Field of Classification Search ..... 297/16.1, 297/148, 153, 256.15, 361.1, 363, 364, 368, 297/188.21

See application file for complete search history.

(56) References Cited

U.S. PATENT DOCUMENTS 697,372 A * 4/1902 Smitz ..... 297/153
2,515,261 A * 7/1950 Poskin ..... 297/364
3,425,744 A * 2/1969 Spector et al. ..... 297/19
3,784,252 A * 1/1974 Peterson ..... 297/364
4,762,364 A * 8/1988 Young ..... 297/256.12
4,938,603 A * 7/1990 Turner et al. ..... 297/153
5,246,272 A * 9/1993 Kato et al. ..... 297/364
6,196,629 B1 * 3/2001 Onishi et al. ..... 297/256.12
6,666,505 B1 * 12/2003 Greger et al. ..... 297/148

* cited by examiner

*Primary Examiner*—Peter R. Brown
(74) *Attorney, Agent, or Firm*—Gauthier & Connors LLP

(57) ABSTRACT

An adjustable high chair comprises a frame, a seat portion, and a backrest sequentially connected with each other, as well as a tray connected to the top end of the seat portion, in addition to an adjusting unit installed at the back of the backrest. The adjusting unit comprises a guiding piece for guiding movement, and an actuating piece, at least a transmitting piece, a sliding piece, and a securing piece sequentially cooperated each other, as well as a button served as a secondary safety lock. Two distal ends of the securing pieces are respectively engaged into a plurality of recesses to fix the backrest at a certain inclination angle. When the actuating piece is pressed to the extent that the securing piece is escaped from the recesses, the backrest can be adjusted and its inclination can be changed. If the actuating piece and the button are pressed simultaneously, the backrest can be adjusted to have the largest inclination angle. Besides, the seat portion comprises a movable piece having bumps which are engaged into slits formed at the arms in different heights to adjust the tray in height.

52 Claims, 7 Drawing Sheets

ADJUSTABLE HIGH CHAIR

FIELD OF THE INVENTION

The present invention relates generally to an adjustable high chair, and more particularly to a high chair for infants, having a secondary safety lock, whose backrest can be adjusted to have different inclinations.

BACKGROUND OF THE INVENTION

As shown in FIG. 1, a conventional high chair 9' (or stroller) mainly has a seat portion 1', a backrest 2', two arms 12', a frame 4', and a plurality of wheels 8', all of which are pivotally connected sequentially. The conventional high chair 9' further comprises a tray 3' connected to the arms 12' and an adjusting unit (not shown) installed at the joint of the backrest 2' and the seat portion 1' for adjusting the inclination of the backrest 2' relative to the seat portion 1', with only one safety lock.

The position of the adjusting unit results in the inconvenience of assembling the adjusting unit due to confining space. The only one safety lock may results in sudden and large-ranged inclination of the backrest 2', which frightens or moreover hurts the infants if the high chair 9' is adjusted when the infants are sitting therein. In addition, either because the height of the tray 3' connected to the arms 12 and the distance between the tray 3' and the backrest 2' cannot be adjusted, or because the distance between the tray 3' and the backrest 2' can be adjusted while the height of the tray 3' cannot be adjusted, the conventional high chair 9' cannot be adapted for all infants with different statures.

SUMMARY OF THE INVENTION

Accordingly, the present invention relates to an adjustable high chair whose adjusting unit is easy to be mounted thereto.

One object of the present invention is the provision of an adjustable high chair whose backrest can be adjusted step by step to prevent the infants therein from being frightened or hurt.

Another object of the present invention is the provision of an adjustable high chair whose tray can be adjusted in height to be adapted for all infants with different statures.

Additional features and advantages of the invention will be set forth in the description which follows, and in part will be apparent from the description, or may be learned by practice of the invention. The objectives and advantages of the invention will be realized and attained by the structure particularly pointed out in the written description and claims hereof as well as the appended drawings.

To achieve these and other advantages and according to the purpose of the present invention, as embodied and broadly described, an adjustable high chair comprising: a seat portion; a backrest pivotally connected to the seat portion; and an adjusting unit pivotally connected to the seat portion and the backrest. Said adjusting unit further comprising: a sliding piece movably connected to the backrest; an actuating piece movably restricted by the sliding piece; at least a transmitting piece, one end of the transmitting piece connected to the actuating piece and the other end thereof connected to the sliding piece; and a securing piece passing through the sliding piece, two ends thereof engaged to the seat portion to restrict the backrest from pivotally rotating relative to the seat portion. The backrest is allowed to pivotally rotate relative to the seat portion when the actuating piece is pressed to cooperate the securing piece to the extent that the two ends of the securing piece are escaped from the seat portion.

It is preferred that the adjusting unit further comprises a guiding piece connected to the backrest and guiding the slide of the actuating piece.

It is preferred that the guiding piece is integrally formed with the backrest.

It is preferred that the seat portion has a plurality of flutes for the securing piece to be respectively engaged into so that the backrest is fixed relatively to the seat portion at a predetermined angle.

It is preferred that a plurality of recesses are further provided in one of the flutes for the securing piece to be respectively engaged into.

It is preferred that each of the transmitting pieces is pivotally connectedly at a point between two ends to the backrest.

It is preferred that the adjusting unit further comprises a button connected to the actuating piece and serving as a safety lock whereby the actuating piece can be moved again when the button is pressed.

It is preferred that the adjusting unit further has a button served as a safety lock connected to the actuating piece and when the button is pressed, the securing piece is escaped from the flute with a plurality of recesses in order to be engaged into another flute.

It is preferred that the high chair further has a tray connected to the seat portion.

It is preferred that the seat portion further has an arm and a movable piece engaged with the arm each other and the movable piece is connected to the tray to adjust the tray in height.

It is preferred that the movable piece has a bump and the arm has a plurality of slits situated at different heights for the bump to be respectively engaged into so as to adjust the tray in height.

It is preferred that the high chair further comprises a frame pivotally connected the seat portion.

It is preferred that an adjustable high chair, comprising: a seat portion; a backrest pivotally connected to the seat portion; and an adjusting unit pivotally connected to the seat portion and the backrest. Said adjusting unit further comprising: a guiding piece connected to the backrest; an actuating piece movably restricted by the guiding piece; at least a transmitting piece, one end thereof connected to the actuating piece; a sliding piece connected to the other end of the transmitting piece; and a securing piece passing through the sliding piece, two ends thereof engaged to the seat portion to restrict the backrest from pivotally rotating relative to the seat portion. The backrest is allowed to pivotally rotate relative to the seat portion when the actuating piece is pressed to cooperate the securing piece to the extent that the two ends of the securing piece are escaped from the seat portion.

It is to be understood that both the forgoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of the specification, illustrate embodiments of the invention and together with the description serve to explain the principle of the invention. In the drawings.

DETAILED DESCRIPTION OF THE INVENTION

Figure 1:
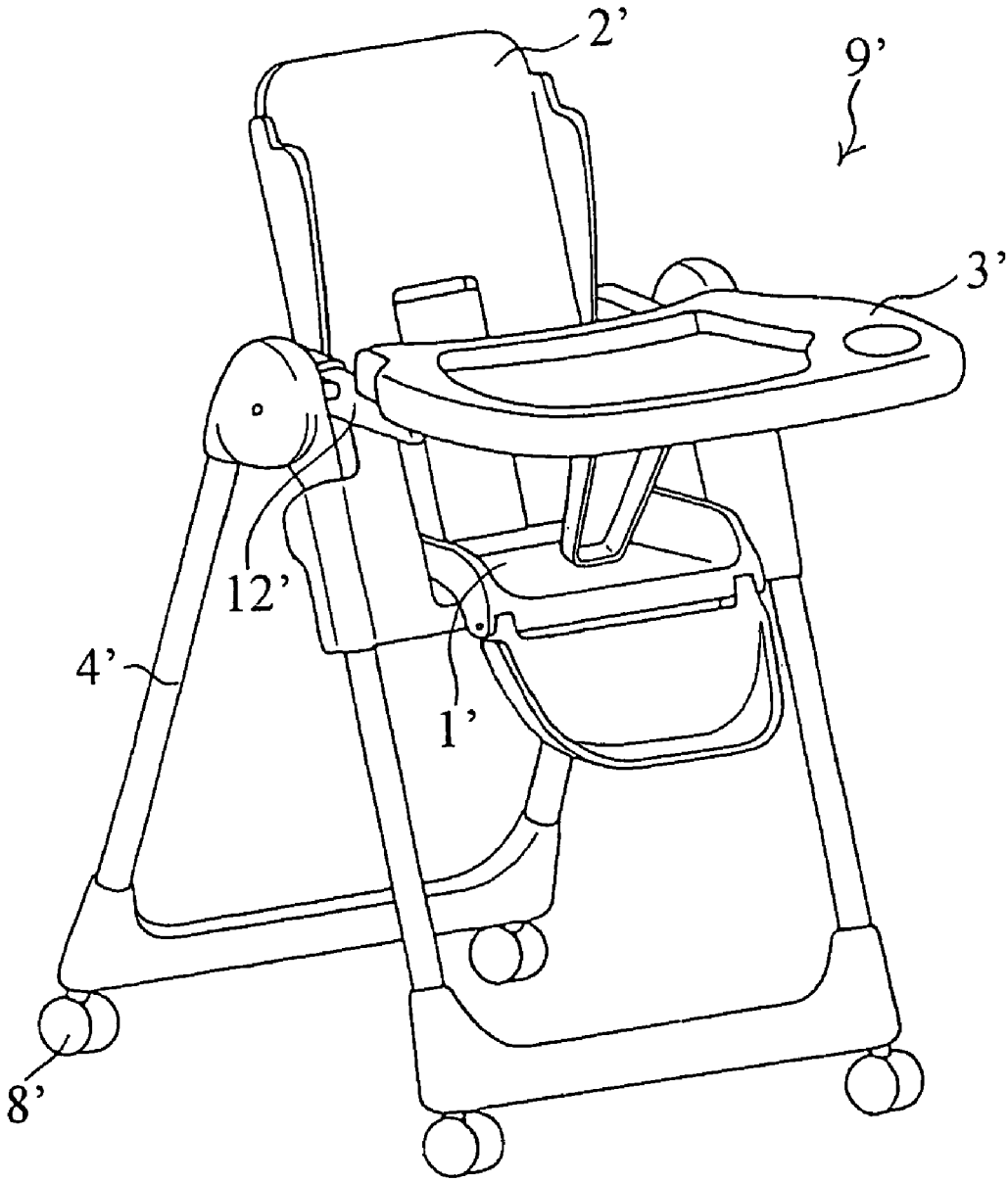
FIG. 1 is an assembled perspective view illustrating a conventional high chair.

As illustrated in FIGS. 2, 3, 4 and 6, the first preferred embodiment of the adjustable high chair for the infants according to the present invention comprises a seat portion 1, an upwardly extending backrest 2 pivotally connected to rear part of the seat portion 1 at two sides, a tray 3 for being placed articles thereon connected onto front part of the seat portion 1 at two sides, a downwardly extending frame 4 pivotally connected to middle part of the seat portion 1 at two sides, and an adjusting unit 5 secured to the back of the backrest 2 at upper part and downwardly extending to engage with the seat portion 1 at two sides, wherein the prior art can be adopted as the pivotally connecting structure between the seat portion 1 and the backrest 2 and that between the seat portion 1 and the frame 4, so that there are no further descriptions thereof hereinafter.

The seat portion 1 comprises a tabular seat plank 11, two arms 12 upwardly extending respectively from two sides of the seat plank 11, and two T-shaped movable pieces 13 partially accommodated respectively in the arms 12. Each arm 12 has a flute 121 and a gutter 122 on top surface 123 of the rear half section. A shoulder 124 is formed at one end in longitudinal direction of the flute 121 near the top surface 123 and three recesses 125 are configured at the bottom of the flute 121 for adjusting inclination of the backrest 2. A shell 126 with an upward opening is formed at the front half section of each arm 12. Four column of slits 127, with three slits 127 in each column, are juxtaposed on outer wall of each shell 126 and four slits 127 laterally aligned with each other are constructed a group. Two laterally parallel flexible fingers 132, each with two round bumps 133 at lower end, are integrally molded at lower section of each movable piece 13.

The top end 134 of each movable piece 13 is engaged with the bottom end of the tray 3 and the lower section of each movable piece 13 is accepted in the shell 126 of each arm 12. By means of the four bumps 133 being engaged into one group of slits 127 formed on the shell 126, the tray 3 is secured at a predetermined height above the arm 12. When the four bumps 133 are pressed by one hand from outside of the shell 126 to inside of the shell 126, the bumps 133 retract into the shell 126 due to elastic deformation of the flexible finger 132; at the meantime, the movable piece 13 is pulled up or pushed down by another hand to the extent that the bumps 133 are engaged into another group of slits 127 by means of the restoration force of the flexible finger 132 so as to secure the tray 3 at another predetermined height above the arm 12 in order to hereby achieve the object of adjusting the tray 3 in height for being adapted to all infants with different statures. When the bumps 133 are engaged into the lowest group of the slits 127, the high chair 9 is adapted to be folded at this state so as to reduce the volume after being collapsed. Besides, the tray 3 can be further separated from the movable pieces 13 to make the volume of the high chair 9 collapsed much smaller.

With reference to FIGS. 6, 7, 8 and 9, the adjusting unit 5 comprises a lying U-shaped guiding piece 51, a reversing U-shaped and rod-like securing piece 52, a rectangle-like actuating piece 53, a rectangular button 54, two transmitting pieces 55 like isosceles triangle, and a reversing U-shaped sliding piece 56.

The guiding piece 51 has a first side wall 511 and a second side wall 512 respectively extending outwardly (i.e. backwardly) from and perpendicularly to the back of the backrest 2 and laterally juxtaposed, a third side wall 513 laterally connecting the first side wall 511 and the second side wall 512, and an upper opening 514 and a lower opening 515 defined by the three side walls 511, 512, and 513. Two passages 516 reaching to the upper opening 514 are respectively formed at the upper section of the first side wall 511 and second side wall 512 near the backrest 2. A rectangular aperture 517 is provided at the central part of the third side wall 513. A flange 518 extends outwardly from and perpendicularly to the third side wall 513 at the end near the upper opening 514.

The securing piece 52 has two side portions 521, two distal ends 522 respectively situated at lower ends of the two side portions 521, and a bridge portion 523 connecting the two side portions 521 at upper ends.

The actuating piece 53 has two holes 531 laterally juxtaposed near the lower end thereof and a forward cavity 532 (referring to FIG. 8) formed at the central part thereof. There are two regular chasms 533 respectively situated at two laterally side walls defining the cavity 532. The button 54 is integrally in form of a cover with a front opening 541 and has two flexible tabs 542 respectively extending forwardly at two lateral sides. Each flexible tab 542 has a barb 543 at distal end thereof. Each transmitting piece 55 has a first slot 551 and a second slot 552 respectively installed near the two equal angles and a bore 553 installed near the third angle.

A first elastic element 544 is placed into the button 54 and then the button 54 and elastic element 544 are together put into the cavity 532 of the actuating piece 53. By means of two barbs 543 of the button 54 being respectively engaged into two chasms 533 situated at two side walls of the actuating piece 53, the button 54 is movably connected to the actuating piece 53. At the same time, the button 54, when not being pushed, always backwardly protrudes partially outside of the actuating piece 53 and permits repeatedly pushing the button 54 by the aid of the first elastic element 544 accommodated between the button 54 and the actuating piece 53. Next, two first pivotal elements 554, such as rivets, respectively pass through one of holes 531 of the actuating piece 53 and the first slots 551 of two transmitting pieces 55 to pivotally connect the actuating piece 53 and two transmitting pieces 55 together. Subsequently, after the bridge portion 523 of the securing piece 52 is placed into the passages 516 of the guiding piece 51, the sub-combination of the actuating piece 53, button 54, first elastic element 544, and transmitting pieces 55 is inserted into the guiding piece 51 from upper opening 514 to lower opening 515 thereof and the button 54 is simultaneously engaged into the aperture 517 of the guiding piece 51. Then two second pivotal elements 555 respectively pass through the bores 553 of two transmitting piece 55 and the annular poles 21 to pivotally connect two transmitting pieces 55 to the backrest 2.

The reversing U-shaped sliding piece 56 comprises two longitudinal side members 561 laterally arranged, a bridge member 562 connecting the two side members 561 at upper ends thereof and extending first backwardly and then laterally, and a space 563 defined by the bridge member 562 and two side members 561. Each side member 561 is equipped with an elongated hole 564 at upper part thereof, a notch 565 at the front of the central part thereof, a chamber 566 (referring to FIG. 9) at lower part thereof, an annular pin 567 extending forwardly from lower end.

Figure 2:
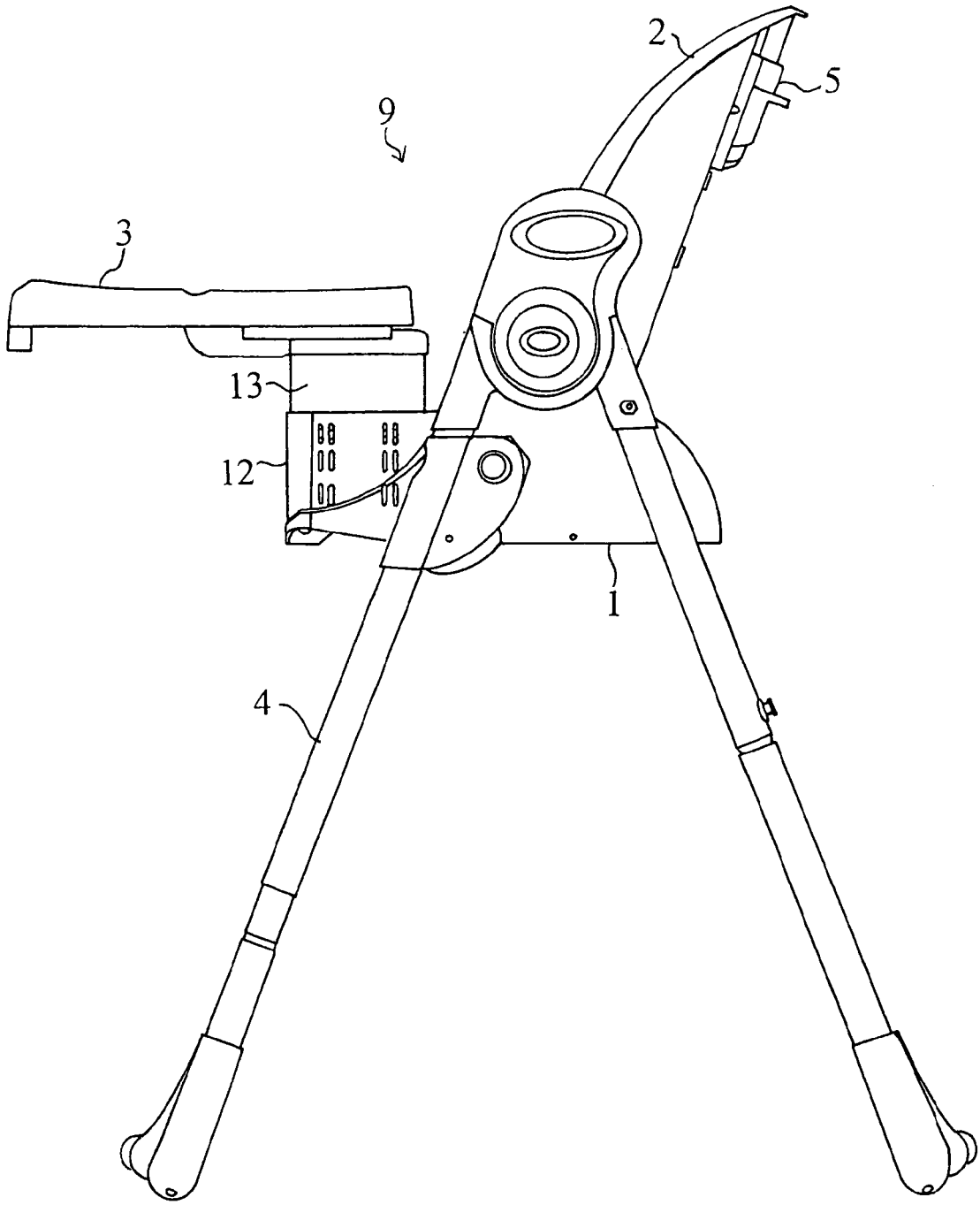
FIG. 2 is an assembled side view of the adjustable high chair according to the present invention.
Figure 3:
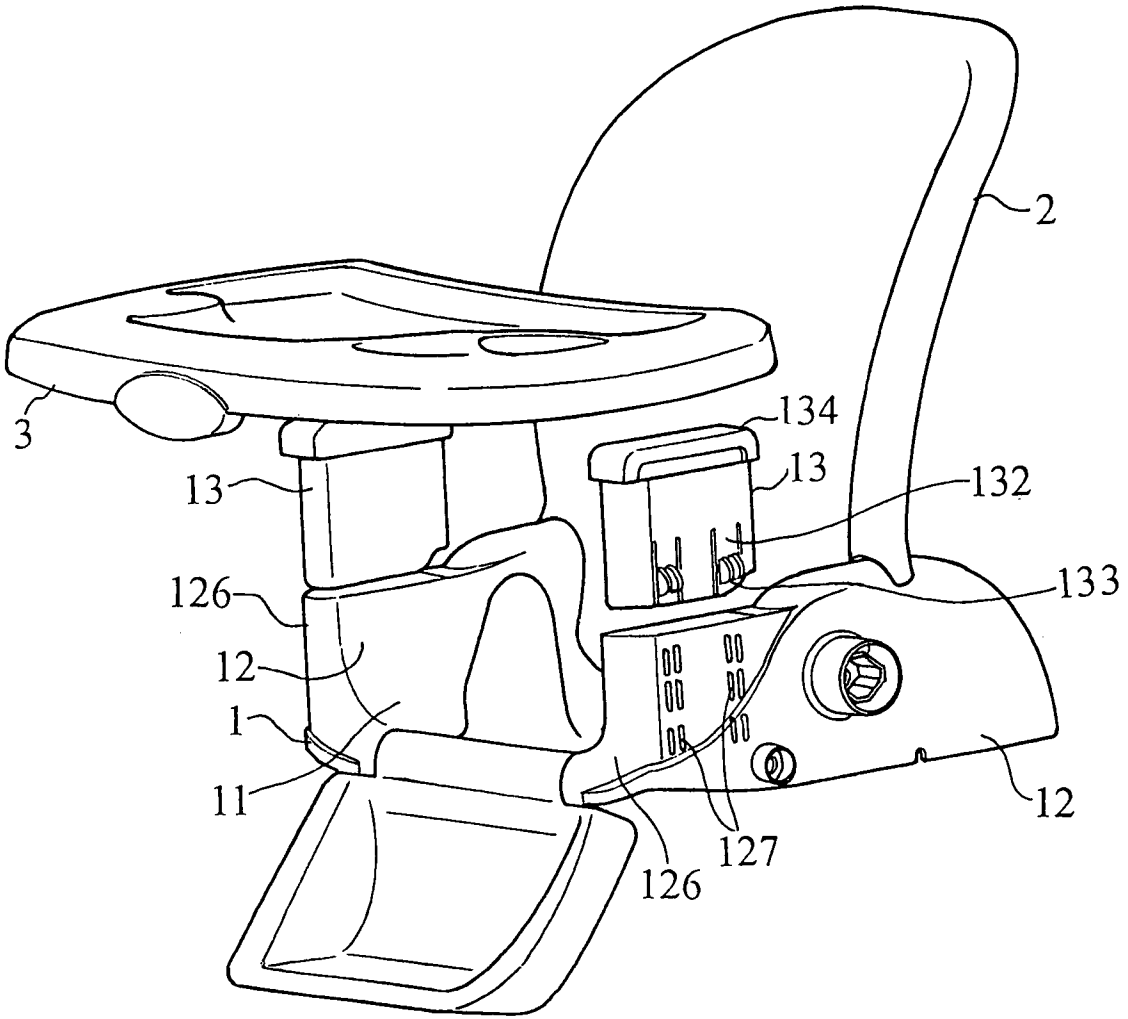
FIG. 3 is an assembled perspective view of the adjustable high chair according to the present invention but not showing the frame and adjusting unit.
Figure 4:
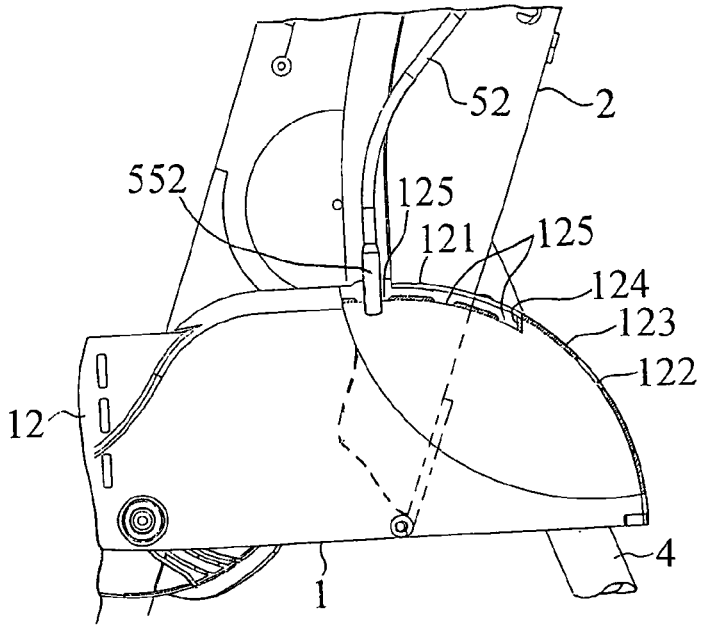
FIG. 4 is a partial assembled side view of the adjustable high chair according to the present invention illustrating the engaging state near the arm at a small angle of inclination.
Figure 5:
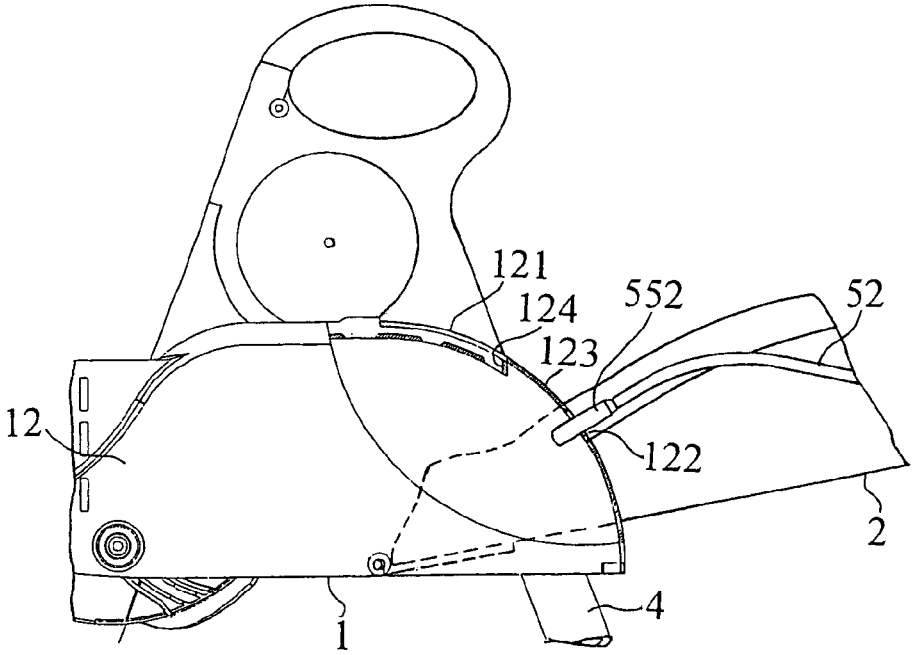
FIG. 5 is a partial assembled side view of the adjustable high chair according to the present invention illustrating the engaging state near the arm at a large angle of inclination.
Figure 6:
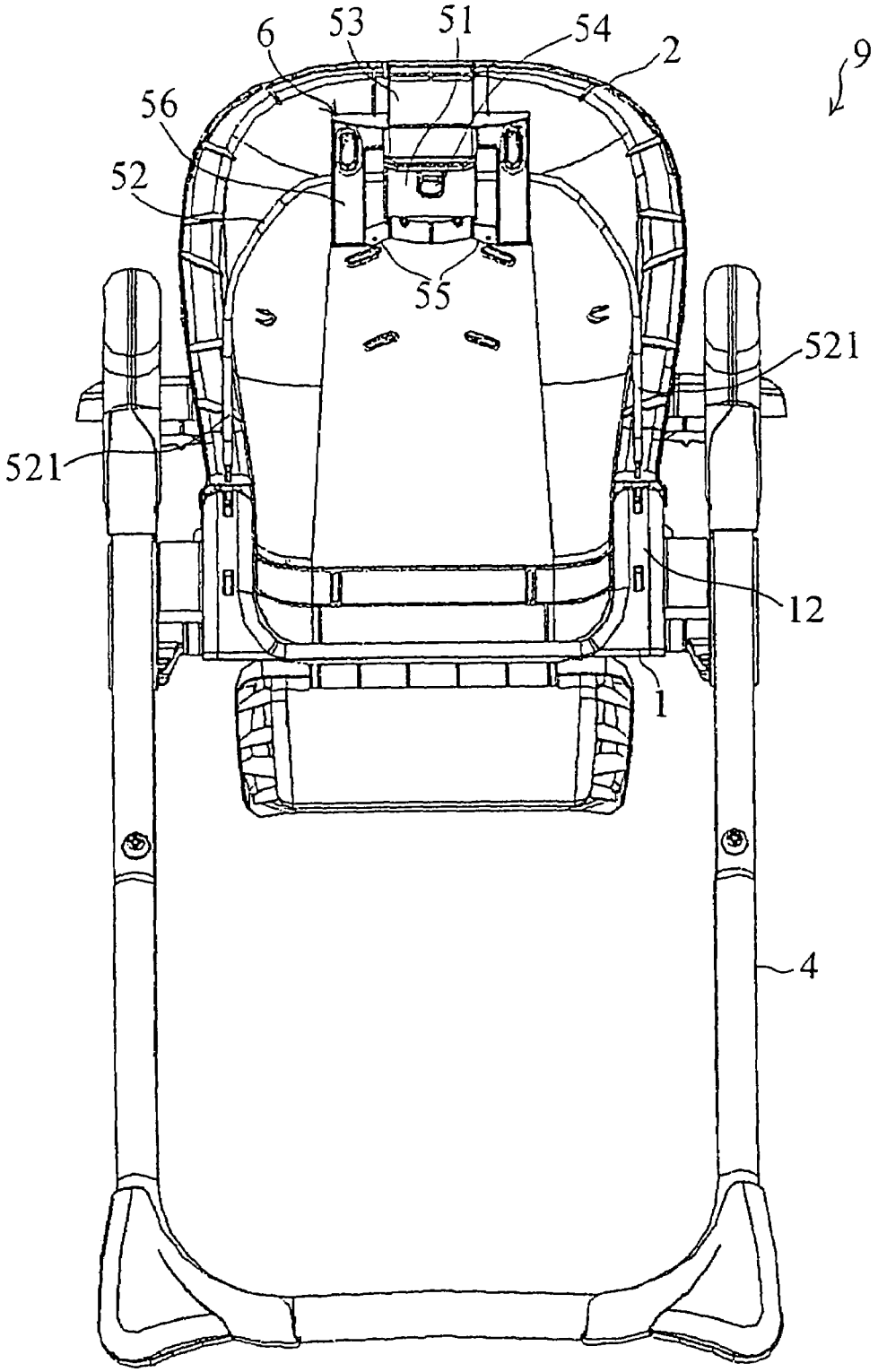
FIG. 6 is a rear perspective view of the adjustable high chair according to the present invention.
Figure 7:
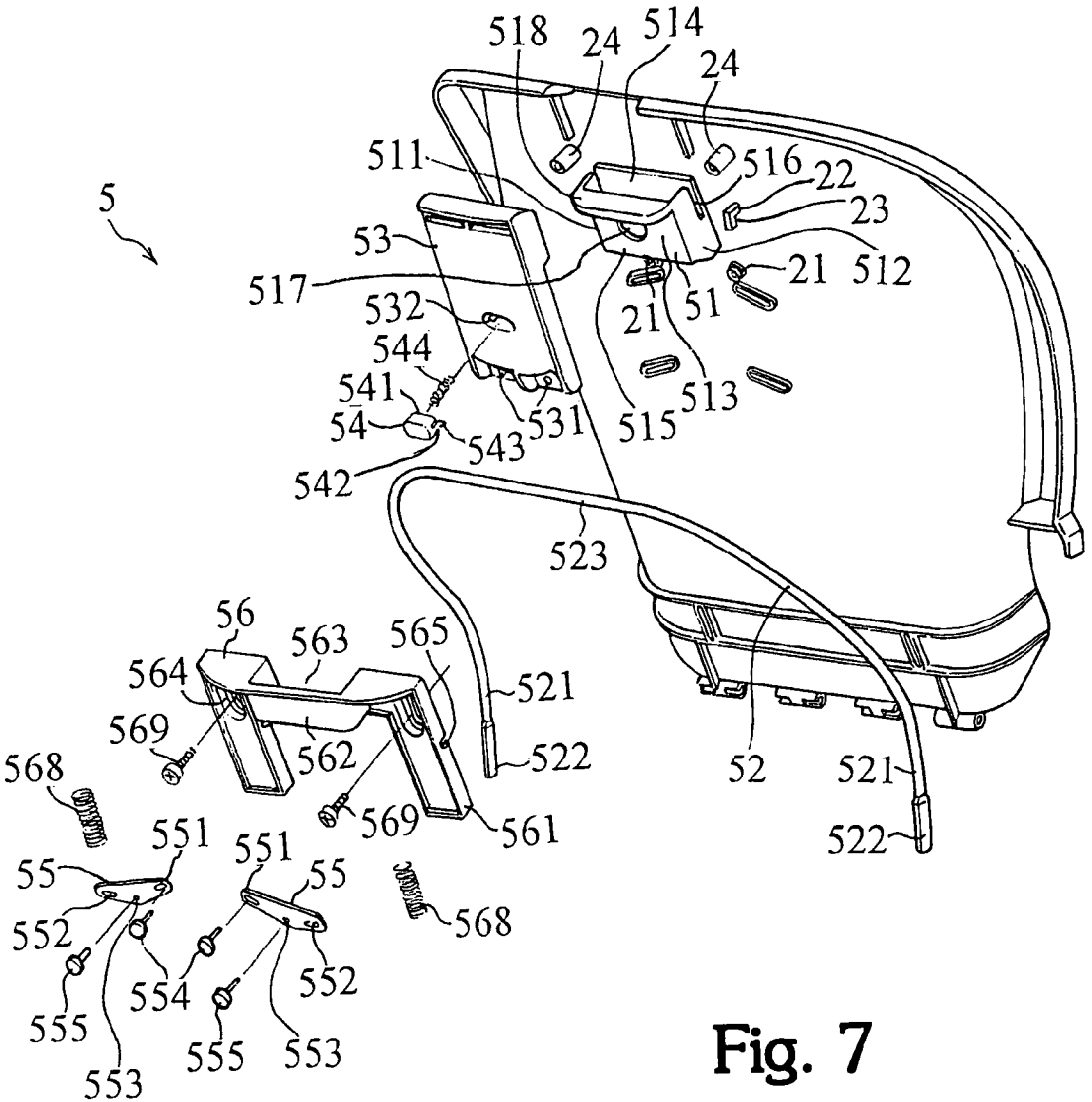
FIG. 7 is a partial exploded perspective view of the adjustable high chair according to the present invention illustrating the parts of the adjusting unit.
Figure 9:
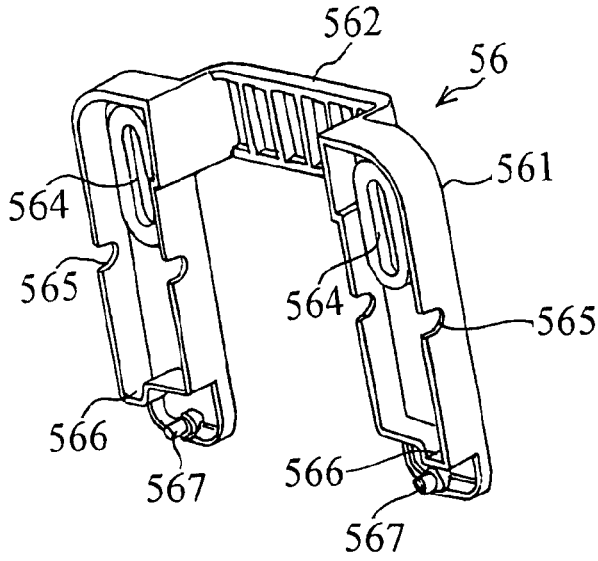
FIG. 9 is a perspective view of the sliding piece of the adjustable high chair according to the present invention.
Figure 8:
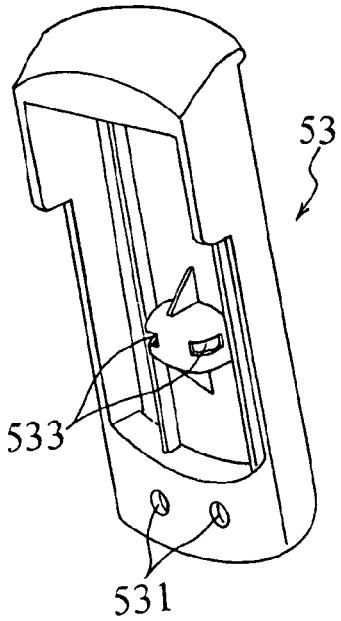
FIG. 8 is a perspective view of the actuating piece of the adjustable high chair according to the present invention.

The lower ends of two second elastic elements 568 are respectively received in the chambers 566 of two side members 561 of the sliding piece 56. The upper end of each second elastic element 568 is respectively received in the gaps 23 between the backrest 2 and two tags 23 (only one is shown in FIG. 2) extending out of the backrest 2 first and then downwardly. Next, two annular pins 567 of the sliding piece 56 respectively pass through the second slots 552 provided at another corner of the transmitting pieces 55. Simultaneously, the bridge portion 523 of the securing piece 52 is received in two notches 565 of the transmitting pieces 55, the actuating piece 53 is accommodated in the space 563 of the transmitting pieces 55, and two annular stakes 24 extending from the back of the backrest 2 respectively pass through two elongated holes 564. Then, two third pivotal elements 569, such as bolts, are respectively screwed into two annual stakes 24 to movably limit the sliding piece 56 to the backrest 2.

With reference to FIGS. 4, 5, 6, and 7, when the actuating piece 53 is not pushed yet, the two distal ends 522 of the securing piece 52 are respectively situated in the corresponding recesses 125 of the arms 12, which serves to prevent the backrest 2 from rotating relative to the seat portion 1. On the contrary, when the actuating piece 53 is pushed by a hand to the extent that the lower end of the button 54 contacts the bottom of the aperture 517 of the guiding piece 51, the ends of each transmitting piece 55 with the first slot 551 are pressed down by the actuating piece 53 and the other ends of each transmitting piece 55 with the second slot 552 swing upwardly. Simultaneously, the sliding piece 56 is upwardly cooperated by the annular pins 567 of the sliding piece 56 to compress the second elastic elements 568 and the securing piece 52 is lifted by the inner wall of the notch 565 in the sliding piece 56 to the extent that two distal ends 522 of the securing piece 52 is above the corresponding recess 125 but still in the flute 121 of the arms 12, that is the distal ends 522 of the securing piece 52 is still beneath the upper surface 123 of the arms 12, so that the distal ends 522 of the securing piece 52 can only move in the flute 121. At this time, the backrest 2 can be rotated to a predetermined angle where the distal ends of the securing piece 52 are aligned with one of recesses 125 in each arm 12. After withdrawing the hand which pushes the actuating piece 53 previously, the sliding piece 52 is moved downwardly by the aid of the restoration force of the second elastic elements 568. The transmitting pieces 55 are cooperated and rotated by the sliding piece 56 to upwardly push the actuating piece 53 returning to its normal position.

As described above, when the actuating piece 53 is pushed by one hand to the extent that the lower end of the button 54 contacts the bottom of the aperture 517 of the guiding piece 51, the actuating piece 53 can not be moved downwardly any more. However, at this state, if the button 54 is simultaneously pushed with another hand to make the rear surface of the button 54 situate in front of the third side surface 513, thus the button 54 can escape from the obstruction of the bottom of the aperture 517 in the guiding piece 51 and the actuating piece 53 is allowed to further move downwardly. Through the cooperating of the transmitting pieces 55 and sliding piece 56, the distal ends 522 of the securing piece 52 can further move upwardly to situate above the upper surfaces 123 of the arms 12. Therefore, when the backrest 2 is rotated, each distal end 522 of the securing piece 52 will not be stopped by the shoulder 124 between the flute 121 and the upper surface 123 and can be further rotated to the gutter 122. At this position, if the actuating piece 53 is released from being pressed, the sliding piece 56 and securing piece 52 are descent and the actuating piece 53 is lifted by the aid of restoration force of the second elastic elements 568, and consequently the distal ends 522 of the securing piece 52 are respectively engaged into the gutters 122.

In view of the above description, it is apparent that the button 54 is served as a secondary safety lock, i.e., when the high chair 9 is operated with only one hand pushing the actuating piece 53 (serving as a first safety lock), due to the obstruction of shoulders 124 to the distal ends 522 of the securing piece 52, the distal ends 522 of the securing piece 52 can only be moved in the flute 121, relatively smaller range. Accordingly, the backrest 2 would not be suddenly rotated to about 180° relative to the seat portion 1, which can prevent the infants sitting in the high chair 9 from being frightened or even hurt. If only if the button 54 (i.e. the secondary safety lock) is simultaneously pressed by another hand when the actuating piece 53 (serving as a first safety lock) is pressed by one hand, the actuating piece 53 can be downwardly moved further and cooperate the securing piece 52 to make the distal ends 522 to be above the shoulders 124 and the upper surfaces 123 so that the backrest 2 can be pivotally rotated further and finally the securing piece 52 is engaged into the gutter 122. In this state, the high chair 9 is adapted for being folded.

Besides, the adjusting unit 5 is installed at the upper part of the backrest 2 and then extends downwardly to be engaged into the arms 12 so that the space for assembling operation is large, which is convenient for assembling operation.

In a second preferred embodiment according the present invention, the guiding piece 51 of the adjusting unit 5 may be omitted and the aperture 517 is provided at the center of the bridge member 562 of the sliding piece 56. In this way, the transmitting pieces 55 still can be pivotally connected to the backrest 2 by the second pivotal elements 555 and the sliding piece 56 is also pivotally connected to the backrest 2 by the third pivotal elements 569 so as to make the entire adjusting unit 5 be connected to the backrest 2. At the same time, the potential lateral movement of the actuating piece 53 is restricted by both side members 561 of the sliding piece 56, the potential front-rear movement of the actuating piece 53 is restricted by the bridge member 562, and the actuating piece 53 can only longitudinally slide up and down under the guide of the sliding piece 56. Moreover, because the aperture 517 of the guiding piece 51 in the first preferred embodiment is also provided at the bridge member 562 of the sliding piece 56 in the second preferred embodiment for restricting the button 54 up and down moving in a certain range, the button 54 still has the function of the second safety lock. Therefore, the second preferred embodiment has the whole effects of the first preferred embodiment and can achieve all objects of the present invention.

This invention has been disclosed in terms of specific embodiments. It will be apparent that many modifications can be made to the disclosed structures without departing from the invention. Therefore, it is the intent of the appended claims to cover all such variations and modifications as come within the true sprit and scope of this invention.

What is claimed is:

1. An adjustable high chair, comprising:

a seat portion;

a backrest pivotally connected to the seat portion; and an adjusting unit pivotally connected to the seat portion and the backrest;

said adjusting unit further comprising:

a guiding piece connected to the backrest;

an actuating piece movably restricted by the guiding piece;

at least a transmitting piece, one end thereof connected to the actuating piece;

a sliding piece connected to the other end of the transmitting piece; and a securing piece passing through the sliding piece, two ends thereof engaged to the seat portion to restrict the backrest from pivotally rotating relative to the seat portion;

wherein the backrest is allowed to pivotally rotate relative to the seat portion when the actuating piece is pressed and the securing piece is cooperated to the extent that the two ends of the securing piece are escaped from the seat portion;

wherein the seat portion has a plurality of flutes for the securing piece to be respectively engaged into so that the backrest is fixed relatively to the seat portion at a predetermined angle;

wherein a plurality of recesses are further provided in one of the flutes for the securing piece to respectively engaged into;

wherein the adjusting unit is further provided with a button which serves as a safety lock and is connected to the actuating piece wherein when the button is pressed, the ends of the securing piece are disengaged from the corresponding recesses.

2. The adjustable high chair as claimed in claim 1, wherein the guiding piece is integrally formed with the backrest.

3. The adjustable high chair as claimed in claim 1, wherein each transmitting piece is pivotally connected at a point between two ends to the backrest.

4. The adjustable high chair as claimed in claim 1, wherein the high chair further has a tray connected to the seat portion.

5. The adjustable high chair as claimed in claim 4, wherein the seat portion further has an arm and a movable piece engaged with the arm and the movable piece is connected to the tray to adjust the tray in height.

6. The adjustable high chair as claimed in claim 5, wherein the movable piece has a bump and the arm has a plurality of slits situated at different heights for the bump to be respectively engaged into to adjust the tray in height.

7. The adjustable high chair as claimed in claim 1, wherein the high chair further comprises a frame pivotally connected the seat portion.

8. An adjustable high chair, comprising:

a seat portion;

a backrest pivotally connected to the seat portion; and an adjusting unit pivotally connected to the seat portion and the backrest;

said adjusting unit further comprising:

a sliding piece movably connected to the backrest;

an actuating piece movably restricted by the sliding piece;

at least a transmitting piece, one end thereof connected to the actuating piece and the other end thereof connected to the sliding piece; and a securing piece passing through the sliding piece, two ends thereof engaged to the seat portion to restrict the backrest from pivotally rotating relative to the seat portion;

wherein the backrest is allowed to pivotally rotate relative to the seat portion when the actuating piece is pressed and the securing piece is cooperated to the extent that the two ends of the securing piece are escaped from the seat portion;

wherein the adjusting unit further comprises a button connected to the actuating piece and serving as a safety lock wherein the actuating piece can be moved and then be blocked by the sliding piece when the botton is not pressed, and the actuating piece can be moved further when the button is pressed.

9. The adjustable high chair as claimed in claim 8, wherein the adjusting unit further comprises a guiding piece connected to the backrest and guiding the slide of the actuating piece.

10. The adjustable high chair as claimed in claim 9, wherein the guiding piece is integrally formed with the backrest.

11. The adjustable high chair as claimed in claim 8 or 9, wherein the seat portion has a plurality of flutes for the securing piece to be respectively engaged into so that the backrest is fixed relatively to the seat portion at a predetermined angle.

12. The adjustable high chair as claimed in claim 11, wherein a plurality of recesses are further provided in one of the flutes for the securing piece to respectively engaged into.

13. The adjustable high chair as claimed in claim 12, wherein the adjusting unit is further provided with a button which serves as a safety lock and is connected to the actuating piece wherein when the button is pressed, the ends of the securing piece are disengaged from the corresponding recesses.

14. The adjustable high chair as claimed in claim 8 or 9, wherein each of the transmitting pieces is pivotally connectedly at a point between two ends to the backrest.

15. The adjustable high chair as claimed in claim 8 or 9, wherein the high chair further has a tray connected to the seat portion.

16. The adjustable high chair as claimed in claim 15, wherein the seat portion further has an arm and a movable piece engaged with the arm and the movable piece is connected to the tray to adjust the tray in height.

17. The adjustable high chair as claimed in claim 16, wherein the movable piece has a bump and the arm has a plurality of slits situated at different heights for the bump to be respectively engaged into to adjust the tray in height.

18. The adjustable high chair as claimed in claim 8 or 9, wherein the high chair further comprises a frame pivotally connected the seat portion.

19. An adjustable high chair, comprising:

a seat portion;

a backrest pivotally connected to the seat portion; and an adjusting unit pivotally connected to the seat portion and the backrest; said adjusting unit further comprising:

a guiding piece connected to the backrest;

an actuating piece movably restricted by the guiding piece;

at least a transmitting piece, one end thereof connected to the actuating piece;

a sliding piece connected to the other end of the transmitting piece; and a securing piece passing through the sliding piece, two ends thereof engaged to the seat portion to restrict the backrest from pivotally rotating relative to the seat portion;

wherein the backrest is allowed to pivotally rotate relative to the seat portion when the actuating piece is pressed and the securing piece is cooperated to the extent that the two ends of the securing piece are escaped from the seat portion;

wherein the high chair further has a tray connected to the seat portion;

wherein the seat portion further has an arm and a movable piece engaged with the arm and the movable piece is connected to the tray to adjust the tray in height;

wherein the movable piece has a bump and the arm has a plurality of slits situated at different heights for the bump to be respectively engaged into to adjust the tray in height.

20. The adjustable high chair as claimed in claim 19, wherein the guiding piece is integrally formed with the backrest.

21. The adjustable high chair as claimed in claim 19, wherein each transmitting piece is pivotally connected at a point between two ends to the backrest.

22. The adjustable high chair as claimed in claim 19, wherein the high chair further comprises a frame pivotally connected the seat portion.

23. An adjustable high chair, comprising:

a seat portion;

a backrest pivotally connected to the seat portion; and an adjusting unit pivotally connected to the seat portion and the backrest;

said adjusting unit further comprising:

a sliding piece movably connected to the backrest;

an actuating piece movably restricted by the sliding piece;

at least a transmitting piece, one end thereof connected to the actuating piece and the other end thereof connected to the sliding piece; and a securing piece passing through the sliding piece, two ends thereof engaged to the seat portion to restrict the backrest from pivotally rotating relative to the seat portion;

wherein the backrest is allowed to pivotally rotate relative to the seat portion when the actuating piece is pressed and the securing piece is cooperated to the extent that the two ends of the securing piece are escaped from the seat portion;

wherein the high chair further has a tray connected to the seat portion;

wherein the seat portion further has an arm and a movable piece engaged with the arm and the movable piece is connected to the tray to adjust the tray in height;

wherein the movable piece has a bump and the arm has a plurality of slits situated at different heights for the bump to be respectively engaged into to adjust the tray in height.

24. The adjustable high chair as claimed in claim 23, wherein the adjusting unit further comprises a guiding piece connected to the backrest and guiding the slide of the actuating piece.

25. The adjustable high chair as claimed in claim 24, wherein the guiding piece is integrally formed with the backrest.

26. The adjustable high chair as claimed in claim 23 or 24, wherein the seat portion has a plurality of flutes for the securing piece to be respectively engaged into so that the backrest is fixed relatively to the seat portion at a predetermined angle.

27. The adjustable high chair as claimed in claim 26, wherein a plurality of recesses are further provided in one of the flutes for the securing piece to respectively engaged into.

28. The adjustable high chair as claimed in claim 27, wherein the ad lusting unit is further provided with a button which serves as a safety lock and is connected to the actuating piece wherein when the button is pressed, the ends of the securing piece are disengaged from the corresponding recesses.

29. The adjustable high chair as claimed in claim 23 or 24, wherein each of the transmitting pieces is pivotally connectedly at a point between two ends to the backrest.

30. The adjustable high chair as claimed in claim 23 or 24, wherein the high chair further comprises a frame pivotally connected the seat portion.

31. An adjustable high chair, comprising:

a seat portion;

a backrest pivotally connected to the seat portion; and an adjusting unit pivotally connected to the seat portion and the backrest;

said adjusting unit further comprising;

a guiding piece connected to the backrest;

an actuating piece movably restricted by the guiding piece;

a transmitting piece having two ends and a pivoting bore between the two ends, the transmitting piece being pivotally connected at the pivoting bore to the backrest, one of the two ends being connected to the actuating piece;

a sliding piece connected to the other end of the transmitting piece; and a securing piece passing through the sliding piece, two ends thereof engaged to the seat portion to restrict the backrest from pivotally rotating relative to the seat portion;

wherein the backrest is allowed to pivotally rotate relative to the seat portion when the actuating piece is pressed and the transmitting piece is rotated about the pivoting bore by the actuating piece and the sliding piece is pushed by the transmitting piece so that the securing piece is cooperated by the sliding piece to the extent that the two ends of the securing piece are escaped from the seat portion.

32. The adjustable high chair as claimed in claim 31, wherein the actuating piece and the sliding piece are moved in contrary directions.

33. The adjustable high chair as claimed in claim 31, wherein the guiding piece is integrally formed with the backrest.

34. The adjustable high chair as claimed in claim 31, wherein the seat portion has a plurality of flutes for the securing piece to be respectively engaged into so that the backrest is fixed relatively to the seat portion at a predetermined angle.

35. The adjustable high chair as claimed in claim 34, wherein a plurality of recesses are further provided in one of the flutes for the securing piece to respectively engaged into.

36. The adjustable high chair as claimed in claim 35, wherein the adjusting unit is further provided with a button which serves as a safety lock and is connected to the actuating piece wherein when the button is pressed, the ends of the securing piece are disengaged from the corresponding recesses.

37. The adjustable high chair as claimed in claim 31, wherein the high chair further has a tray connected to the seat portion.

38. The adjustable high chair as claimed in claim 37, wherein the seat portion further has an arm and a movable piece engaged with the arm and the movable piece is connected to the tray to adjust the tray in height.

39. The adjustable high chair as claimed in claim 38, wherein the movable piece has a bump and the arm has a plurality of slits situated at different heights for the bump to be respectively engaged into to adjust the tray in height.

40. The adjustable high chair as claimed in claim 31, wherein the high chair further comprises a frame pivotally connected the seat portion.

41. An adjustable high chair, comprising:

a seat portion;

a backrest pivotally connected to the seat portion; and an adjusting unit pivotally connected to the seat portion and the backrest;

said adjusting unit further comprising:

a sliding piece movably connected to the backrest;

an actuating piece movably restricted by the sliding piece;

a transmitting piece having two ends and a pivoting bore between the two ends, the transmitting piece being pivotally connected at the pivoting bore to the backrest, one of the two ends being connected to the actuating piece, the other end of the two ends being connected to the sliding piece; and a securing piece passing through the sliding piece, two ends thereof engaged to the seat portion to restrict the backrest from pivotally rotating relative to the seat portion;

wherein the backrest is allowed to pivotally rotate relative to the seat portion when the actuating piece is pressed and the transmitting piece is rotated about the pivoting bore by the actuating piece and the sliding piece is pushed by the transmitting piece so that the securing piece is cooperated by the sliding piece to the extent that the two ends of the securing piece are escaped from the seat portion.

42. The adjustable high chair as claimed in claim 41, wherein the actuating piece and the sliding piece are moved in contrary directions.

43. The adjustable high chair as claimed in claim 41, wherein the adjusting unit further comprises a guiding piece connected to the backrest and guiding the slide of the actuating piece.

44. The adjustable high chair as claimed in claim 43, wherein the guiding piece is integrally formed with the backrest.

45. The adjustable high chair as claimed in claim 41 or 43, wherein the seat portion has a plurality of flutes for the securing piece to be respectively engaged into so that the backrest is fixed relatively to the seat portion at a predetermined angle.

46. The adjustable high chair as claimed in claim 45, wherein a plurality of recesses are further provided in one of the flutes for the securing piece to respectively engaged into.

47. The adjustable high chair as claimed in claim 46, wherein the adjusting unit is further provided with a button which serves as a safety lock and is connected to the actuating piece wherein when the button is pressed, the ends of the securing piece are disengaged from the corresponding recesses.

48. The adjustable high chair as claimed in claim 41 or 43, wherein the adjusting unit further comprises a button connected to the actuating piece and serving as a safety lock wherein the actuating piece can be moved and then be blocked by the sliding piece when the botton is not pressed, and the actuating piece can be moved further when the button is pressed.

49. The adjustable high chair as claimed in claim 41 or 43, wherein the high chair further has a tray connected to the seat portion.

50. The adjustable high chair as claimed in claim 49, wherein the seat portion further has an arm and a movable piece engaged with the arm and the movable piece is connected to the tray to adjust the tray in height.

51. The adjustable high chair as claimed in claim 50, wherein the movable piece has a bump and the arm has a plurality of slits situated at different heights for the bump to be respectively engaged into to adjust the tray in height.

52. The adjustable high chair as claimed in claim 41 or 43, wherein the high chair further comprises a frame pivotally connected the seat portion.

* * * * *